United States Patent [19]

Keller

[11] Patent Number: 4,989,621

[45] Date of Patent: Feb. 5, 1991

[54] HAIR WINDING DEVICE

[76] Inventor: Dieter Keller, Sindelfinger Str. 28, 7030 Böblingen, Fed. Rep. of Germany

[21] Appl. No.: 275,038

[22] PCT Filed: Jul. 21, 1987

[86] PCT No.: PCT/DE87/00326

§ 371 Date: Sep. 2, 1988

§ 102(e) Date: Sep. 2, 1988

[87] PCT Pub. No.: WO88/00445

PCT Pub. Date: Jan. 28, 1988

[30] Foreign Application Priority Data

Jul. 22, 1986 [DE] Fed. Rep. of Germany ..... 3624689

[51] Int. Cl.[5] ..... A45D 2/00; A45D 2/14

[52] U.S. Cl. ..... 132/245; 132/207; 132/254

[58] Field of Search ..... 132/207, 210, 222, 223, 132/226, 254, 266, 245

[56] References Cited

U.S. PATENT DOCUMENTS

| | | | |
|---|---|---|---|
| 3,019,796 | 2/1962 | Reed | 132/222 |
| 3,530,863 | 9/1970 | Foster | 132/222 |
| 3,960,156 | 6/1976 | Thompson | 132/222 |
| 4,344,447 | 8/1982 | Morrow | 132/249 |
| 4,503,870 | 3/1985 | Peterson | 132/270 |
| 4,638,821 | 1/1987 | Smith | 132/222 |

*Primary Examiner*—John J. Wilson

*Assistant Examiner*—Frank A. LaViola, Jr.

[57] ABSTRACT

The invention relates to a hair winding device for taking up and winding on hair strands. A hair winding rod (1), consists of two parts (2, 3) connected with each other in an articulated manner. At least one foil sheet is attached to the rod foaming protective foils (3, 4) which are impermeable to the waving fluid secured to each of the both parts of the hair winding rod to produce a root permanent wave. Those protective foils project by a considerable length transversely to the longitudinal axis of the hair winding rod.

9 Claims, 2 Drawing Sheets

Figure 1:
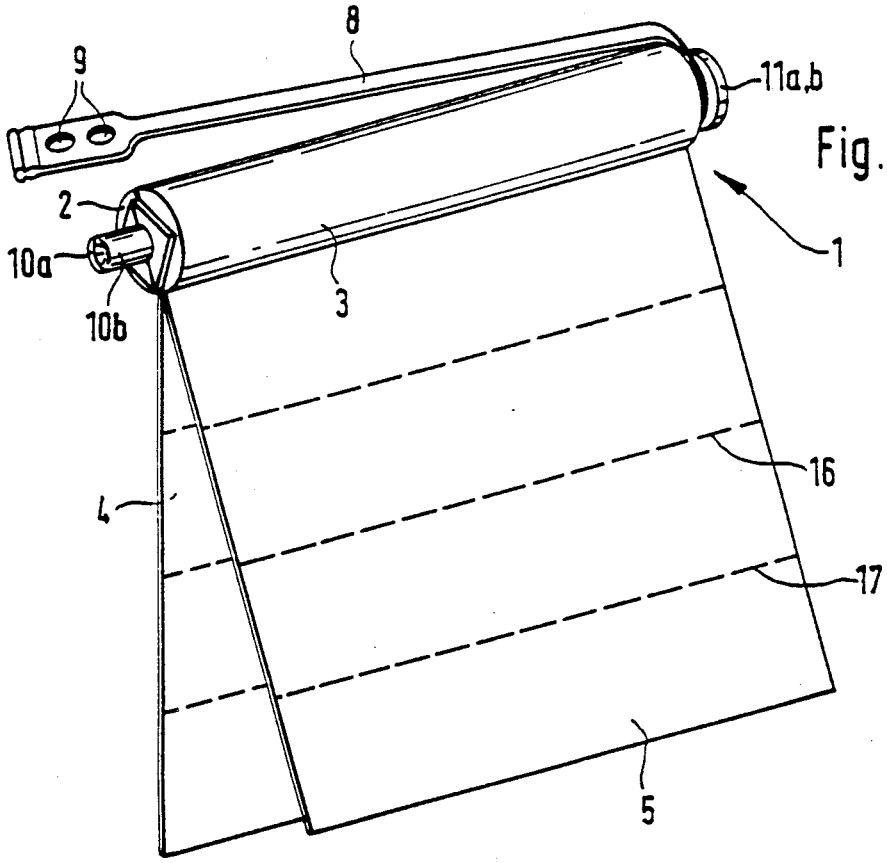

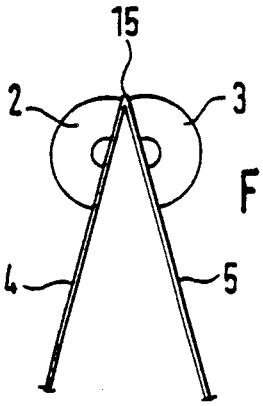
Fig. 6
Fig. 7
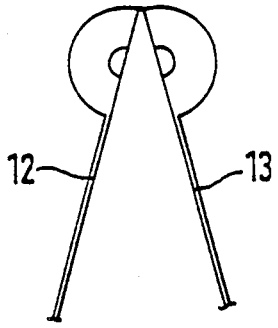
Fig. 8
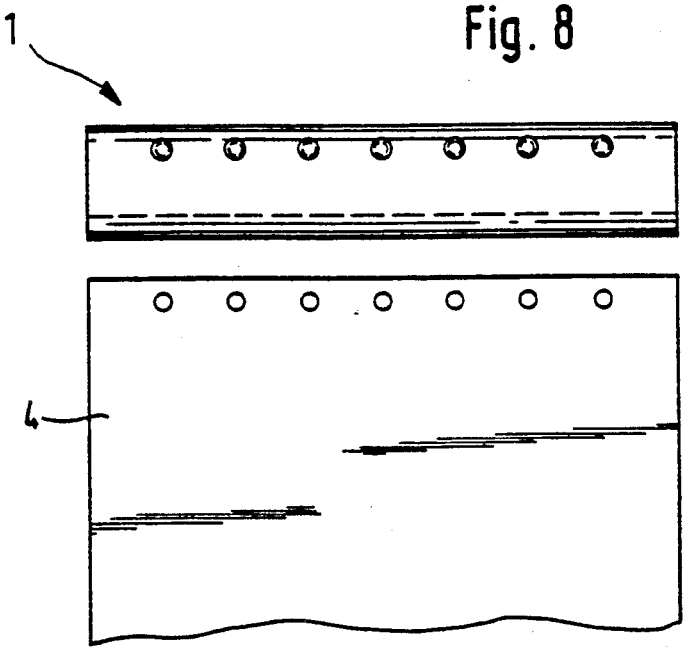

HAIR WINDING DEVICE

The invention relates to a hair winding device with means of taking up and winding individual hair strands with one hair winding rod, consisting of two parts connected with each other so that they are articulated, and with at least one foil attached to this.

Such a hair winding device is known from US-A-35 30 863, for example. The foil used here is porous and allows the waving fluid to act uniformly o the hair.

Additionally, two-part hair winding device are also known, e.g. from US-A-2046 586 and GB-A 285.

In addition to the normal permanent wave or water wave, there has recently been a desire for a so-called root wave, both as a permanent wave and as a water wave. In principle, this is a wave in which only part of the hair strands are provided with a permanent wave or water wave.

For this purpose, clamping of an extremely thin plastic foil together with the hair strand is known from GB-A 2 28 652. When the strands are wound on, part of the hair strands are thus covered by the foil, so that this part cannot be waved, as is indeed the intention. In this way, hair styles are obtained where the hair is waved only from the hair root on the scalp over a length of 4–8 cm, for example, while the remaining part of the hair remains untreated, depending on the length of the foil.

This method is, however, very time-consuming, inefficient and difficult to handle and also requires a good deal of practice. For this reason, acceptance of this method by customers is initially low.

The extremely thin protective foil, which must be pulled off a roll or which is pre-manufactured, tends to stick together as a result of electrostatic charging and to fold and is thus overall a very unmanageable material. This is particularly so because the protective foil has to be relatively thin.

The task on which the invention is based is thus to create a hair winding device of the type specified above which solves this problem for production of root permanent waves or root water waves as well as for partial permanent waves and partial water waves in an amazingly simple way.

The hair winding device designed in accordance with the invention is characterized by the fact that a protective foil which is impermeable for the waving fluid is attached to each of the two parts of the hair winding rod for production of a root permanent wave or root water wave, this foil projecting by a considerable length transversely to the longitudinal extent of the hair winding device.

An arrangement where the two protective foils are secured internally on both parts of the hair winding rod is preferable.

It is also advantageous if the two protective foils are secured externally on the hair winding rod on both parts and are secured wound round up to the gap formed by the two parts.

The other claims should be referred to for further embodiments of the invention.

The invention will now be explained in more detail on the basis of the example embodiments in conjunction with the enclosed drawings.

The drawings show

Figure 2:
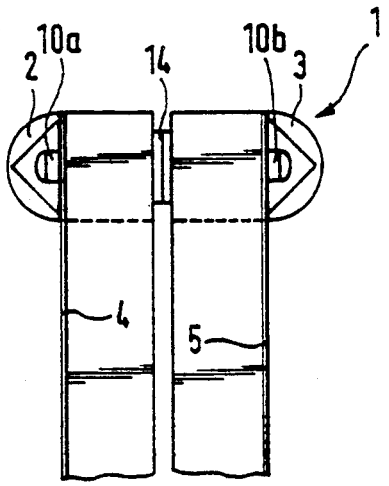
Figure 3:
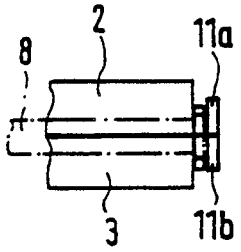

FIG. 1 a first example embodiment of a hair winding device in accordance with the invention;

FIG. 2 a partial view of the hair winding device in FIG. 1 opened up at an acute angle;

FIG. 3 a further partial view of the hair winding device in FIG. 1;

FIGS. 4 to 7 further embodiments of the hair winding device in accordance with the invention and FIG. 8 an example embodiment for detachable securing of a protective foil.

FIG. 1 shows a hair winding rod 1 consisting of two halves 2 and 3 divided in longitudinal direction. The hair winding rod 1 shown here is cylindrical, but may have a slightly smaller diameter towards the center, so that a slightly concave curvature is produced in the side view.

It is also possible to see two protective foils 4 and 5 and a clamping strip 8 with two openings 9, which can be hooked into a peg 10 consisting of two parts 10*a*, 10*b* The clamping strip 8 is hooked into a peg 11, which is also divided into two parts 11*a*, 11*b* at the other end. In the simplest form, this clamping strip may already represent an articulated connection between the two parts 2 and 3.

To produce a root permanent wave or root water wave, for example, the hair winding rod, 1 is opened up and the hair strands are inserted between the two parts 2 and 3, whereby insertion is particularly easy. The hair winding rod is then closed and the hair strands are wound on. The part of the hair strands covered by the foils 4 and 5 is then protected against the effect of the agents producing the permanent wave or water wave, so that this part of the hair strand is not waved. The clamping strip 8 is then used to secure the hair winding device on the head.

FIG. 2 shows a view of the hair winding device in accordance with the invention from left in FIG. 1 such that the two parts 2 and 3 form an acute angle with each other. It is again possible to recognize parts 2 and 3, the parts 10*a* and 10*b* of the peg 10 and a hinge connection at the other end arranged between the two parts. This hinge connection is designated by 14 here and consists of a flexible material.

Figure 4:
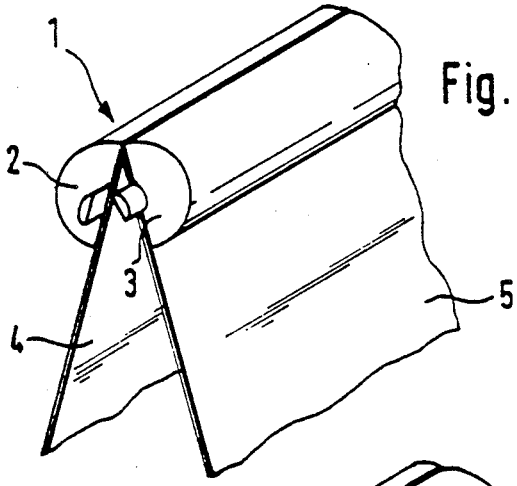

FIG. 3 then shows a top view the right side of the hair winding device with the parts 2 and 3 and the peg parts 11*a* and 11*b* which form the peg. It is also possible to see part of the clamping strip 8, which is indicated by the dash-dot line FIG. 4 shows a partial view of the hair winding device in accordance the invention, where the foils 4 and 5 are secured inside on the parts 2 and 3 of the hair winding rod.

Figure 5:
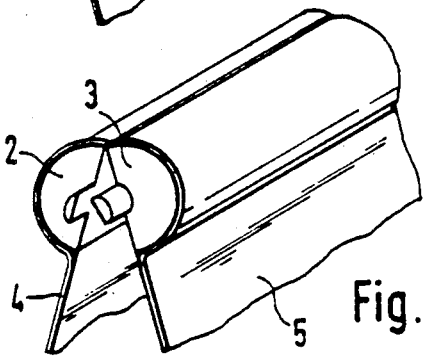

FIG. 5 shows a similar embodiment with the difference that the foils 4 and 5 are glued or otherwise secured on the outer surface of parts 2 and 3.

These two example embodiments may be provided either with a hinge right outer end or with a hinge in the longitudinal direction between parts 2 and 3.

FIG. 6 shows a simple example of this type in principle. The foils 4, 5, consisting of one folded piece or sheet, are secured respectively on the inner side of parts 2 and 3 and simultaneously form the articulated connection or hinge connection 15.

FIG. 7 shows an embodiment of the invention which is particularly simple to produce where the part 2 with foil 4 is shown as a single-piece part 12 and part 3 with foil 5 as a single-piece part 13, which parts may be connected either in longitudinal direction by a hinge 15 or at one end with a hinge 14.

Finally, FIG. 8 shows one of the many possibilities of securing an interchangeable protective foil 4, where the foil is provided with holes and can then be hooked onto corresponding pegs in one of the two parts, whereby the other foil has corresponding holes, so that the protective foils are reliably held when the hair winding device is folded together.

Since is not very expedient to keep a supply of a large number of different lengths of protective foils separately from the hair winding devices, and since it is even less expedient to keep a supply of a large number of hair winding devices with protective foils of different lengths, the protective foils 4 and 5 are provided with length markings 16, which are preferably designed as required tear-off lines 17. In this way, it is possible to produce the length required in each case, depending on the customer's wishes, by tearing off a part of each foil.

This new hair winding device possesses a series of unforeseeable advantages compared with the hair winding devices with "free-flying" protective foils used up to now for root permanent waves:

1. The hair strands can be inserted in the hair winding device simply either flush or non-flush, even between the protective foils, and can thus be firmly clamped before winding In this way, it is possible to hold hair strands of different lengths. The hair ends projecting in the case of non-flush clamping can then still be shortened and evened out.

2. The length of the impermeable protective foils can be selected arbitrarily from case to case.

3. The hair is not wound round the hair winding device directly during winding, but is always inserted between the foils. This is extremely desirable for hygienic reasons. Foil interchangeability also serves the same purpose.

4. The use of two foils assures that the waving fluid and the vapours given off by it are reliably kept away from the part of the hair which is not to be waved.

5. From all this, it can be concluded that considerable simplification can be achieved with the help of the hair winding device designed in accordance with the invention and that the treatment time for winding can be reduced to approximately half or a third of the previously required time. Consequently, this method possible with the new hair winding device is much more customer friendly and could therefore help this permanent wave method which protects the hair to spread much further, since the otherwise unavoidable multiple chemical stressing of the hair ends is dispensed with.

I claim:

1. Hair winding device with means of taking up and winding on hair strands, comprising: a hair winding rod (1) having a longitudinal axis and consisting of 2 parts (2, 3), means for connecting said parts to each other in an articulated manner and at least one foil attached to said rod, the improvement comprising two thin protective foils (4, 5) impermeable to waving fluid and secured respectively onto each of the two parts of the hair winding rod, face to face with free ends extending radially from the two-part rod, to produce a root permanent wave, and said protective foils projecting over a considerable length transversely to the longitudinal axis of the hair winding rod for winding about the hair winding rod with the hair strands captured therebetween.

2. Hair winding device in accordance with claim 1, wherein the two thin protective foils (4, 5) are secured, respectively internally on said parts (2, 3) of the hair winding rod.

3. Hair winding device in accordance with claim 1, wherein the two thin protective foils (4, 5) are secured, respectively externally on the hair winding rod (1) on said parts (2, 3) and are wound around the two parts and secured thereto.

4. Hair winding device in accordance with claim 1, wherein the two thin protective foils (4, 5) are permanently secured on the parts (2, 3).

5. Hair winding device in accordance with claim 1, wherein the two thin protective foils are detachably secured on the parts (2, 3).

6. Hair winding device in accordance with claim 1. wherein said parts are articulated by a side articulated joint (15) between the two parts (2, 3) consisting of a piece of thin flexible foil.

7. Hair winding device in accordance with claim 1. wherein the two parts and the two thin protective foils (12, 13) are of one piece formed of a same material.

8. Hair winding device in accordance with claim 1. wherein the two thin protective foils comprise length markings extending in a direction of the longitudinal axis of the rod.

9. Hair winding device in accordance with claim 8. wherein said length markings are constituted by tear-off lines (17).

* * * * *

UNITED STATES PATENT AND TRADEMARK OFFICE

CERTIFICATE OF CORRECTION

PATENT NO. : 4,989,621

DATED : February 5, 1991

INVENTOR(S) : Dieter Keller

It is certified that error appears in the above-identified patent and that said Letters Patent is hereby corrected as shown below:

TITLE PAGE:

Abstract [57], line 5, delete "foaming" and insert --forming--;

Column 1, line 13, delete "GB-A 285" and insert --GB-A 342 285--;

Column 1, line 23, delete "GB-A 2 28 652" and insert --GB-A 20 28 652--;

Column 2, line 56, after "hinge" and before "right, insert --at the--.

Signed and Sealed this

Eighth Day of September, 1992

*Attest:*

DOUGLAS B. COMER

*Attesting Officer*

*Acting Commissioner of Patents and Trademarks*